US008309183B2

(12) United States Patent
Lv et al.

(10) Patent No.: US 8,309,183 B2
(45) Date of Patent: Nov. 13, 2012

(54) METHOD OF MAKING MAGNESIUM ALLOY HOUSING

(75) Inventors: Yan-Shuang Lv, Shenzhen (CN); Hui Xia, Shenzhen (CN)

(73) Assignees: Fu Zhun Precision Industry (Shen Zhen) Co., Ltd., Shenzhen, Guangdong Province (CN); Foxconn Technology Co., Ltd., Tu-Cheng, New Taipei (TW)

( * ) Notice: Subject to any disclaimer, the term of this patent is extended or adjusted under 35 U.S.C. 154(b) by 789 days.

(21) Appl. No.: 12/337,750

(22) Filed: Dec. 18, 2008

(65) Prior Publication Data

US 2010/0028601 A1 Feb. 4, 2010

(30) Foreign Application Priority Data

Aug. 4, 2008 (CN) ..... 2008 1 0303355

(51) Int. Cl.
*B05D 7/14* (2006.01)
*B05D 1/02* (2006.01)

(52) U.S. Cl. ..... 427/409; 427/289; 427/355; 427/358; 427/368; 427/372.2; 427/384; 427/388.1; 427/410; 427/430.1; 427/435

(58) Field of Classification Search ..... 427/372.2, 427/384, 388.1, 355, 358, 368, 289, 407.1, 427/409, 410, 430.1, 435
See application file for complete search history.

(56) References Cited

U.S. PATENT DOCUMENTS

| | | | | |
|---|---|---|---|---|
| 5,683,522 | A * | 11/1997 | Joesten | 148/253 |
| 2002/0069940 | A1 * | 6/2002 | Matsunaga et al. | 148/253 |
| 2004/0096677 | A1 | 5/2004 | Imai et al. | |

FOREIGN PATENT DOCUMENTS

| | | | |
|---|---|---|---|
| CN | 1616709 | A | 5/2005 |
| JP | 2001-152393 | A | 6/2001 |
| JP | 2004-220594 | A | 8/2004 |
| WO | WO2007032468 | A1 | 3/2007 |

OTHER PUBLICATIONS

Li et al., "Research of the Stripping off Process of the Paint of Magnesium Alloy Housings of Notebook Computers When Recycling," Special Casting & Nonferrous Alloys, 2007-S1, abstract, 2 pages.*

* cited by examiner

*Primary Examiner* — William Phillip Fletcher, III
(74) *Attorney, Agent, or Firm* — Altis Law Group, Inc.

(57) ABSTRACT

A method of making a magnesium alloy housing includes steps as follows: providing a magnesium alloy base; submerging the magnesium alloy base in a phosphate solution, thereby forming a chemical plating layer on the surface thereof; coating a prime coating on the chemical plating layer and drying the prime coating, thereby forming a prime layer; coating an enamel on the prime layer and drying the enamel, thereby forming a color coating layer; grinding the color coating layer with a grinding wheel, thereby forming a hair line layer; coating a metallic coating on the hair line layer and drying the metallic coating, thereby forming a decorative layer; and coating a transparent coat on the decorative layer and drying the transparent coat, thereby forming a transparent protecting layer.

10 Claims, 1 Drawing Sheet

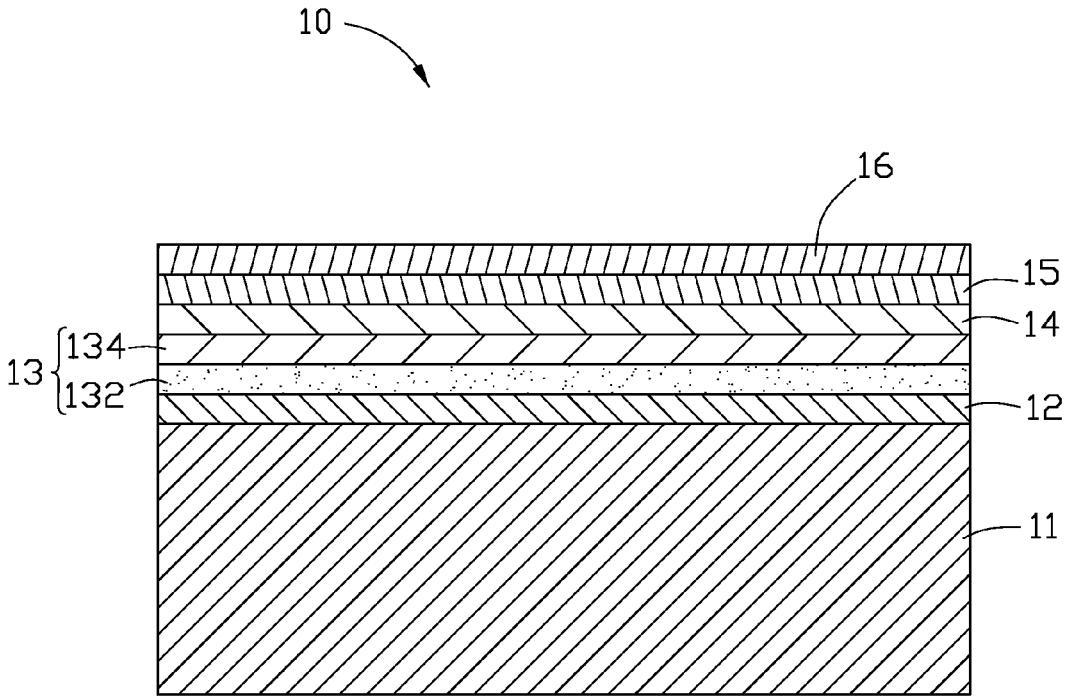
10
16
15
14
13
134
132
12
11

METHOD OF MAKING MAGNESIUM ALLOY HOUSING

BACKGROUND

1. Technical Field

The present invention relates to a housing and, particularly, to a housing for an electronic device.

2. Description of the Related Art

Metals such as aluminum alloy, magnesium alloy, and stainless steel, are good candidates for use in various portable electronic devices such as MP3 players, personal digital assistances (PDAs), and mobile phones because of their high mechanical strength.

In addition, to get a nice appearance and good touch sense, patterns or stripes such as hair lines, are often formed on the housing of an electronic device.

However, if the base is made of magnesium alloy, hair lines formed on the base are more prone to corrosion than other metals because the magnesium alloy reacts easily with other chemical substances such as acids.

Therefore, a magnesium alloy housing is desired in order to overcome the above-described shortcoming.

SUMMARY

A magnesium alloy housing includes a magnesium alloy base, a chemical plating layer, a connecting layer, a hair line layer, and a transparent protecting layer. The chemical plating layer, the connecting layer, the hair line layer, and the transparent protecting layer are formed on the magnesium alloy base in that order.

Other advantages and novel features will become more apparent from the following detailed description of various embodiments, when taken in conjunction with the accompanying drawings.

BRIEF DESCRIPTION OF THE DRAWINGS

The components in the drawings are not necessarily drawn to scale, the emphasis instead being placed upon clearly illustrating the principles of the present magnesium alloy housing.

The drawing is a cross-sectional view of a portion of an embodiment of a magnesium alloy housing.

DETAILED DESCRIPTION

Reference will now be made to the drawings to describe embodiments of the magnesium alloy housing and method of making the same.

Referring to the attached drawing, a magnesium alloy housing 10 includes a magnesium alloy base 11, a chemical plating layer 12, a connecting layer 13, a hair line layer 14, a decorative layer 15, and a transparent protecting layer 16. The chemical plating layer 12, the connecting layer 13, the hair line layer 14, the decorative layer 15, and the transparent protecting layer 16 are formed on the magnesium alloy base 11 in that order.

The magnesium alloy housing 10 may be a front cover, a back cover, a foldable cover or a slidable cover employed in all kinds of electronic devices. The chemical plating layer 12 is configured to prevent the magnesium alloy base 11 from oxidation. In the illustrated embodiment, the chemical plating layer 12 is made mainly of phosphate.

The connecting layer 13 is configured to further improve a corrosion resistance of the magnesium alloy base 11, and to improve a flatness of the magnesium alloy base 11. The connecting layer 13 comprises a prime layer 132 adjacent to the chemical plating layer 12, and a color coating layer 134 formed on the prime layer 132.

The prime layer 132 is configured to enhance a bonding strength between the chemical plating layer 12 and the color coating layer 134. The prime layer 132 may include epoxy resin and black pigments dispersed in the epoxy resin.

The color coating layer 134 has a relatively high hardness and may include acrylic resin and black pigments dispersed in the acrylic resin. The black pigments may be carbon black.

The hair line layer 14 is formed on the color coating layer 134. The decorative layer 15 may be a metallic color coating such as silver coating, thereby achieving a metallic hair line layer 14.

The decorative layer 15 may consist essentially of acrylic resin and aluminum powder or aluminum flakes. In the illustrated embodiment, the decorative layer 15 consists essentially of acrylic resin and aluminum flakes. A thickness of the decorative layer 15 may be in the range from 2 micrometers (μm) to 5 μm. The transparent protecting layer 16 may consist essentially of acrylic resin and has a high bonding strength with the decorative layer 15.

The magnesium alloy base 11 is protected by the chemical plating layer 12 and the prime layer 132, thereby avoiding corrosion. In addition, because the magnesium alloy base 11 is further covered by the connecting layer 13, defects formed on the magnesium alloy base 11 such as pits and thin grooves during the die casting process are masked by the connecting layer 13, thereby improving a uniformity of the hair line and highlighting the effect of the hair line. Furthermore, because the decorative layer 15 is a metal color coating layer, the hair line layer 14 has a good metallic feel.

A method of making the magnesium alloy housing 10 is also provided. Depending on the embodiment, certain of the steps described below may be removed, others may be added, and the sequence of steps may be altered.

In a first step, a magnesium alloy base 11, formed by die casting, is provided.

In a second step, the magnesium alloy base 11 is submerged in a phosphate solution, thereby forming a chemical plating layer 12 on a surface of the magnesium alloy base 11.

In a third step, a prime coating is coated on the chemical plating layer 12 and dried, thereby forming a prime layer 132. The prime coating may consist essentially of epoxy resin and black pigments. The black pigments may be carbon black. A method of coating the prime coating on the chemical plating layer 12 can be accomplished by spray coating.

In a fourth step, an enamel is coated on the prime layer 132 and dried, thereby forming the color coating layer 134. The prime coating may consist essentially of acrylic resin and black pigments. The black pigments may be carbon black. A method of coating the enamel on the prime layer 132 may be accomplished by spray coating.

In a fifth step, the color coating layer 134 is grinded with a grinding wheel, so that a portion of the color coating layer 134 forms the hair line layer 14. The grinding wheel may be made of cloth.

In a sixth step, a metal color coating is coated on the hair line layer 14 and dried, thereby forming the decorative layer 15. The metal color coating may consist essentially of acrylic resin and aluminum flakes, and a thickness of the decorative layer 15 may be 2 μm to 5 μm. A method of coating the metal color coating on the hair line layer 14 may be accomplished by spray coating.

In a seventh step, a transparent coating is coated on the decorative layer 15 and dried, thereby forming a transparent protecting layer 16. The transparent coating may consist essentially of acrylic resin. A method of coating the transparent coating on the decorative layer 15 may be accomplished by spray coating.

It may be appreciated that, the decorative layer 15 may be another color other than the color of the metal. Furthermore, the decorative layer 15 may be omitted.

In one embodiment, the magnesium alloy base formed by die casting is submerged in a phosphate solution, thereby forming a chemical plating layer on the surface thereof. A prime coating, coated on the chemical plating layer, may be comprised mainly of epoxy resin and black pigments. The prime coating may be dried by placing the magnesium alloy base 11 in an oven for a duration in the range from 15 to 20 minutes, at a temperature in the oven in the range from 135 degrees Celsius (° C.) to 145° C., thereby forming the prime layer 132. A thickness of the prime layer 132 may be in the range of 15 μm to 20 μm.

An enamel, coated on the prime layer, may consist essentially of acrylic resin and black pigments. The enamel may also be dried by placing the magnesium alloy base 11 in an oven for a duration in the range from 15 to 20 minutes, at a temperature in the oven in the range from 135° C. to 145° C., thereby forming a color coating layer 134 on the prime layer 132. A thickness of the color coating layer 134 may be in the range of 15 μm to 20 μm.

The color coating layer may be grinded with a grinding wheel, thereby forming a hair line layer.

A silver coating, coated on the hair line layer, may consist essentially of aluminum flakes and acrylic resin. The silver coating may be dried by placing the magnesium alloy base 11 in an oven for a duration in the range from 15 to 20 minutes, at a temperature in the oven in the range from 135° C. to 145° C., thereby forming a decorative layer 15 on the hair line layer 14. A thickness of the decorative layer 15 may be in a range of 2 μm to 3 μm.

A transparent coating, coated on the decorative layer, may consist essentially of acrylic resin. The transparent coating may be dried by placing the magnesium alloy base 11 in an oven for a duration in the range from 15 to 20 minutes, at a temperature in the oven in the range from 135° C. to 145° C., thereby forming a transparent protecting layer 16 on the decorative layer 15. A thickness of the transparent protecting layer 16 is about 12 μm to 18 μm. Thus, a magnesium alloy housing is yielded.

A bonding strength of the samples of the magnesium alloy housing was evaluated with a cross-cut test after the transparent protecting layer was formed. Bonding strengths of the samples of the magnesium alloy housing exceed 3B.

A pencil hardness of the samples of the magnesium alloy housing was evaluated with a pencil after the transparent protecting layer was formed. A pencil was applied on the surface of the magnesium alloy housing at an angle of 45° with a force of 9.8N. The pencil hardness of the samples of the magnesium alloy housing is 3H.

A salt spray test solution used in the salt spray tester including 5% sodium chloride (NaCl) at 35±2° C. was used to test the corrosion resistance of the magnesium alloy housing. After two circulations, in which each circulation includes 8 hours of spraying, and 16 hours without spraying, there was no oxidation, fish-eyes, or ripples on the surface of the magnesium alloy housing.

The test result shows that the magnesium alloy housing has good corrosion resistance, relatively high bonding strength, and high hardness.

Finally, while various embodiments have been described and illustrated, the embodiments are not to be construed as being limited thereto. Various modifications can be made to the embodiments by those skilled in the art without departing from the true spirit and scope of the invention as defined by the appended claims.

What is claimed is:

1. A method of making a magnesium alloy housing, the method comprising:

providing a magnesium alloy base;

submerging the magnesium alloy base in a phosphate solution, thereby forming a chemical plating layer on the surface thereof;

coating a prime coating on the chemical plating layer and drying the prime coating, thereby forming a prime layer;

coating an enamel on the prime layer and drying the enamel, thereby forming a color coating layer;

grinding the color coating layer with a grinding wheel, thereby forming a hair line layer;

coating a metallic coating on the hair line layer and drying the metallic coating, thereby forming a decorative layer; and coating a transparent coat on the decorative layer and drying the transparent coat, thereby forming a transparent protecting layer.

2. The method as claimed in claim 1, wherein the chemical plating layer consists essentially of phosphate.

3. The method as claimed in claim 1, wherein the prime layer consists essentially of epoxy resin and black pigments.

4. The method as claimed in claim 1, wherein the color coating layer consists essentially of acrylic resin and black pigments.

5. The method as claimed in claim 1, wherein the hair line layer is formed on the color coating layer.

6. The method as claimed in claim 1, wherein the decorative layer consists essentially of acrylic resin and aluminum flakes.

7. The method as claimed in claim 6, wherein the transparent protecting layer consists essentially of acrylic resin.

8. The method as claimed in claim 1, wherein the prime coating is dried by placing the magnesium alloy base in an oven for a duration in the range from 15 to 20 minutes, at a temperature in the oven in the range from 135° C. to 145° C.

9. The method as claimed in claim 1, wherein the enamel is dried by placing the magnesium alloy base in an oven for a duration in the range from 15 to 20 minutes, at a temperature in the oven in the range from 135° C. to 145° C.

10. The method as claimed in claim 1, wherein the transparent coating is dried by placing the magnesium alloy base in an oven for a duration in the range from 15 to 20 minutes, at a temperature in the oven in the range from 135° C. to 145° C.

* * * * *